US010815992B2

(12) United States Patent
Yosuke et al.

(10) Patent No.: US 10,815,992 B2
(45) Date of Patent: Oct. 27, 2020

(54) SCROLL COMPRESSOR HAVING OLDHAM COUPLING WITH KEY PORTIONS AND DIFFERENT WIDTH KEY GAPS

(71) Applicant: DAIKIN INDUSTRIES, LTD., Osaka (JP)

(72) Inventors: Yoshinobu Yosuke, Osaka (JP); Takayuki Kawamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 61 days.

(21) Appl. No.: 16/303,098

(22) PCT Filed: Apr. 25, 2017

(86) PCT No.: PCT/JP2017/016399
§ 371 (c)(1),
(2) Date: Nov. 19, 2018

(87) PCT Pub. No.: WO2017/203923
PCT Pub. Date: Nov. 30, 2017

(65) Prior Publication Data

US 2019/0301458 A1 Oct. 3, 2019

(30) Foreign Application Priority Data

May 24, 2016 (JP) ..... 2016-103517

(51) Int. Cl.
*F01C 17/06* (2006.01)
*F04C 18/02* (2006.01)
(Continued)

(52) U.S. Cl.
CPC ..... *F04C 18/0215* (2013.01); *F01C 17/066* (2013.01); *F04C 18/02* (2013.01);
(Continued)

(58) Field of Classification Search
CPC .. F01C 1/0246; F01C 17/066; F04C 18/0246; F04C 18/0215; F04C 29/02; F04C 29/026; F04C 29/028
(Continued)

(56) References Cited

U.S. PATENT DOCUMENTS 5,403,172 A * 4/1995 Blass ..... F01C 17/066 418/55.3
2003/0175139 A1* 9/2003 Joo ..... F04C 28/28 418/55.3
(Continued)

FOREIGN PATENT DOCUMENTS

EP 1 260 713 A2 11/2002
JP 3-151585 A 6/1991
(Continued)

OTHER PUBLICATIONS

English translation of JP 11324943 byJapan Platform for patent information Mar. 9, 2020.*
(Continued)

*Primary Examiner* — Deming Wan
(74) *Attorney, Agent, or Firm* — Global IP Counselors, LLP

(57) ABSTRACT

A scroll compressor includes a movable scroll having first key grooves, a stationary member having second key grooves, and an Oldham coupling provided between the movable scroll and the stationary member. The Oldham coupling is movable with respect to the stationary member along a first axis direction, and with respect to the movable scroll along a second axis direction. The second axis is orthogonal to the first axis and passes through a center of gravity of the Oldham coupling. The Oldham coupling has an annular body portion, at least two first key portions fitted into the first key grooves, and second key portions fitted into the second key grooves. Key gaps are formed between outer
(Continued)

peripheral surfaces of the first key portions and inner peripheral surfaces of the first key grooves. The key gaps have first gaps and second gaps wider than the first gaps.

13 Claims, 14 Drawing Sheets

(51) Int. Cl.
*F04C 29/02* (2006.01)
*F04C 23/00* (2006.01)
*F04C 29/00* (2006.01)

(52) U.S. Cl.
CPC ..... *F04C 23/008* (2013.01); *F04C 29/0057* (2013.01); *F04C 29/02* (2013.01); *F04C 2270/72* (2013.01)

(58) Field of Classification Search
USPC ..... 418/55.6
See application file for complete search history.

(56) References Cited

U.S. PATENT DOCUMENTS

2009/0148326 A1 6/2009 Fujiwara et al.
2009/0185927 A1 6/2009 Duppert et al.

FOREIGN PATENT DOCUMENTS

JP 11324943 A * 11/1999 ..... F01C 17/066
JP 2007-23819 A 2/2007
JP 2011-510209 A 3/2011

OTHER PUBLICATIONS

European Search Report of corresponding EP Application No. 17 80 2521.9 dated Feb. 15, 2019.
International Preliminary Report of corresponding PCT Application No. PCT/JP2017/016399 dated Dec. 6, 2018.
International Search Report of corresponding PCT Application No. PCT/JP2017/016399 dated Aug. 8, 2017.

* cited by examiner

SCROLL COMPRESSOR HAVING OLDHAM COUPLING WITH KEY PORTIONS AND DIFFERENT WIDTH KEY GAPS

CROSS-REFERENCE TO RELATED APPLICATIONS

This U.S. National stage application claims priority under 35 U.S.C. § 119(a) to Japanese Patent Application No. 2016-103517, filed in Japan on May 24, 2016, the entire contents of which are hereby incorporated herein by reference.

TECHNICAL FIELD

The present invention relates to a scroll compressor equipped with an Oldham coupling for preventing self-rotation of a movable scroll.

BACKGROUND ART

A scroll compressor used in a refrigeration system or the like is equipped with a fixed scroll and a movable scroll. The fixed scroll and the movable scroll each have a spiral portion. The spiral portion of the movable scroll interfits with the spiral portion of the fixed scroll, whereby compression chambers, which are spaces in which a fluid such as refrigerant gas is compressed, are formed. The scroll compressor compresses the fluid by causing the movable scroll to orbit to change the volumes of the compression chambers.

Ordinarily the scroll compressor is equipped with an Oldham coupling for preventing self-rotation of the movable scroll during operation. The Oldham coupling is installed between the movable scroll and a fixed member such as a housing. As disclosed in JP A No. 2011-510209, the Oldham coupling has an annular body portion and key portions that project in the vertical direction from the body portion. Each key portion has a surface that slides against the movable scroll or the fixed member. Lubricating oil for preventing seizure of the sliding surfaces is supplied to sliding parts between the Oldham coupling and the movable scroll and sliding parts between the Oldham coupling and the fixed member. If the lubricating oil is not sufficiently supplied to the sliding parts, there is the concern that the sliding surfaces will reach a high temperature and that seizure will occur.

SUMMARY OF THE INVENTION

However, in the case of an Oldham coupling such as disclosed in JP-A No. 2011-510209, only one of the side surfaces of each key portion slides against the outer peripheral surface of the movable scroll. For that reason, the lubricating oil supplied to the sliding parts between the Oldham coupling and the movable scroll leaks out, and the lubricating oil is liable not to be sufficiently supplied to the sliding parts. Because of this, there is the concern that the sliding surfaces of the Oldham coupling and the movable scroll will seize up, thereby reducing the reliability of the compressor.

It is an object of the present invention to provide a scroll compressor that has high reliability by inhibiting seizure of the sliding surfaces of the Oldham coupling and the movable scroll.

A scroll compressor pertaining to a first aspect of the invention is equipped with a movable scroll, a stationary member, and an Oldham coupling. The movable scroll has first key grooves. The stationary member has second key grooves. The Oldham coupling is provided between the movable scroll and the stationary member. The Oldham coupling is relatively movable with respect to the stationary member along a first axis and is relatively movable with respect to the movable scroll along a second axis. The Oldham coupling has an annular body portion, two pairs of first key portions, and second key portions. The annular body portion has a first horizontal surface and a second horizontal surface that oppose each other. The first key portions project from the first horizontal surface and are fitted into the first key grooves. The first key portions are slidable against the movable scroll along the second axis. The second key portions project from the second horizontal surface and are fitted into the second key grooves. The second key portions are slidable against the stationary member along the first axis. Key gaps are formed between outer peripheral surfaces of the first key portions and inner peripheral surfaces of the first key grooves. The key gaps have first gaps and second gaps. The first gaps are formed along the second axis on a center of gravity side of the Oldham coupling. The second gaps are formed along the second axis on the opposite side of the center of gravity side of the Oldham coupling. The second gaps are wider than the first gaps.

In this scroll compressor, the first key portions of the Oldham coupling have sliding surfaces, which are side surfaces on the radial direction inner side of the Oldham coupling, and guide surfaces, which are side surfaces on the radial direction outer side. The sliding surfaces of the first key portions are surfaces that slide against the movable scroll, and the sliding surfaces of the first key portions form the first gaps between themselves and the inner peripheral surfaces of the first key grooves of the movable scroll. The guide surfaces of the first key portions form the second gaps between themselves and the inner peripheral surfaces of the first key grooves of the movable scroll. The second gaps are wider than the first gaps, so the second gaps hold the lubricating oil supplied to the first key grooves more easily than the first gaps do. Because of this, some of the lubricating oil held in the second gaps is supplied to the first gaps, and seizure of the sliding surfaces of the first key portions is inhibited. Consequently, this scroll compressor has high reliability by inhibiting seizure of the sliding surfaces of the Oldham coupling and the movable scroll.

A scroll compressor pertaining to a second aspect of the invention is the scroll compressor pertaining to the first aspect, wherein the first gaps are 15 μm to 50 μm.

In this scroll compressor, the first gaps between the sliding surfaces of the first key portions and the inner peripheral surfaces of the first key grooves are narrow enough to sufficiently inhibit chattering of the sliding Oldham coupling and wide enough to hold a quantity of lubricating oil with which seizure of the sliding surfaces is sufficiently inhibited. For that reason, the occurrence of seizure of the sliding surfaces caused by the lubricating oil not being sufficiently supplied to the first gaps is inhibited.

A scroll compressor pertaining to a third aspect is the scroll compressor pertaining to the first aspect or the second aspect, wherein the second gaps are 200 μm to 1000 μm.

In this scroll compressor, the second gaps between the guide surfaces of the first key portions and the inner peripheral surfaces of the first key grooves can hold a larger quantity of the lubricating oil than the first gaps. Because of this, some of the lubricating oil held in the second gaps is supplied to the first gaps via the gaps between the outer peripheral surfaces of the first key portions and the inner peripheral surfaces of the first key grooves. For that reason, the occurrence of seizure of the sliding surfaces caused by the lubricating oil not being supplied to the first gaps is inhibited.

A scroll compressor pertaining to a fourth aspect of the invention is the scroll compressor pertaining to any one of the first to third aspects, wherein the first key portions are provided one each in four regions partitioned by the first axis and the second axis.

In this scroll compressor, when the Oldham coupling is seen in a top view, the four first key portions are disposed as far away from each other as possible. For that reason, the surface pressure that acts on the sliding surfaces of the first key portions is equally dispersed between the four first key portions. Consequently, the occurrence of seizure at only the sliding surfaces of some of the first key portions is inhibited.

A scroll compressor pertaining to a fifth aspect of the invention is the scroll compressor pertaining to the fourth aspect, wherein the Oldham coupling has a pair of the second key portions. The second key portions are provided on the first axis across the second axis.

In this scroll compressor, when the Oldham coupling is seen in a top view, the two second key portions are disposed as far away from each other as possible. For that reason, the surface pressure that acts on the sliding surfaces of the second key portions is equally disposed between the two second key portions. Consequently, the occurrence of seizure at only the sliding surfaces of the some of the second key portions is inhibited.

A scroll compressor pertaining to a sixth aspect of the invention is equipped with a movable scroll, a stationary member, and an Oldham coupling. The movable scroll has first key grooves. The stationary member has second key grooves. The Oldham coupling is provided between the movable scroll and the stationary member. The Oldham coupling is relatively movable with respect to the stationary member along a first axis and is relatively movable with respect to the movable scroll along a second axis. The Oldham coupling has an annular body portion, at least two first key portions, and second key portions. The annular body portion has a first horizontal surface and a second horizontal surface that oppose each other. The first key portions project from the first horizontal surface and are fitted into the first key grooves. The first key portions are slidable against the movable scroll along the second axis. The second key portions project from the second horizontal surface and are fitted into the second key grooves. The second key portions are slidable against the stationary member along the first axis. Key gaps are formed between outer peripheral surfaces of the first key portions and inner peripheral surfaces of the first key grooves. The key gaps have first gaps and second gaps. The first gaps are formed along the second axis on a center of gravity side of the Oldham coupling. The second gaps are formed along the second axis on the opposite side of the center of gravity side of the Oldham coupling. The second gaps are wider than the first gaps.

The scroll compressor pertaining to the invention has high reliability by inhibiting seizure of the sliding surfaces of the Oldham coupling and the movable scroll.

DETAILED DESCRIPTION OF EMBODIMENT

A scroll compressor 101 pertaining to an embodiment of the invention will be described with reference to the drawings. The scroll compressor 101 is used in a refrigeration system such as an air conditioning system. The scroll compressor 101 compresses refrigerant gas that circulates through a refrigerant circuit of the refrigeration system.

(1) Configuration of Scroll Compressor

Figure 1:
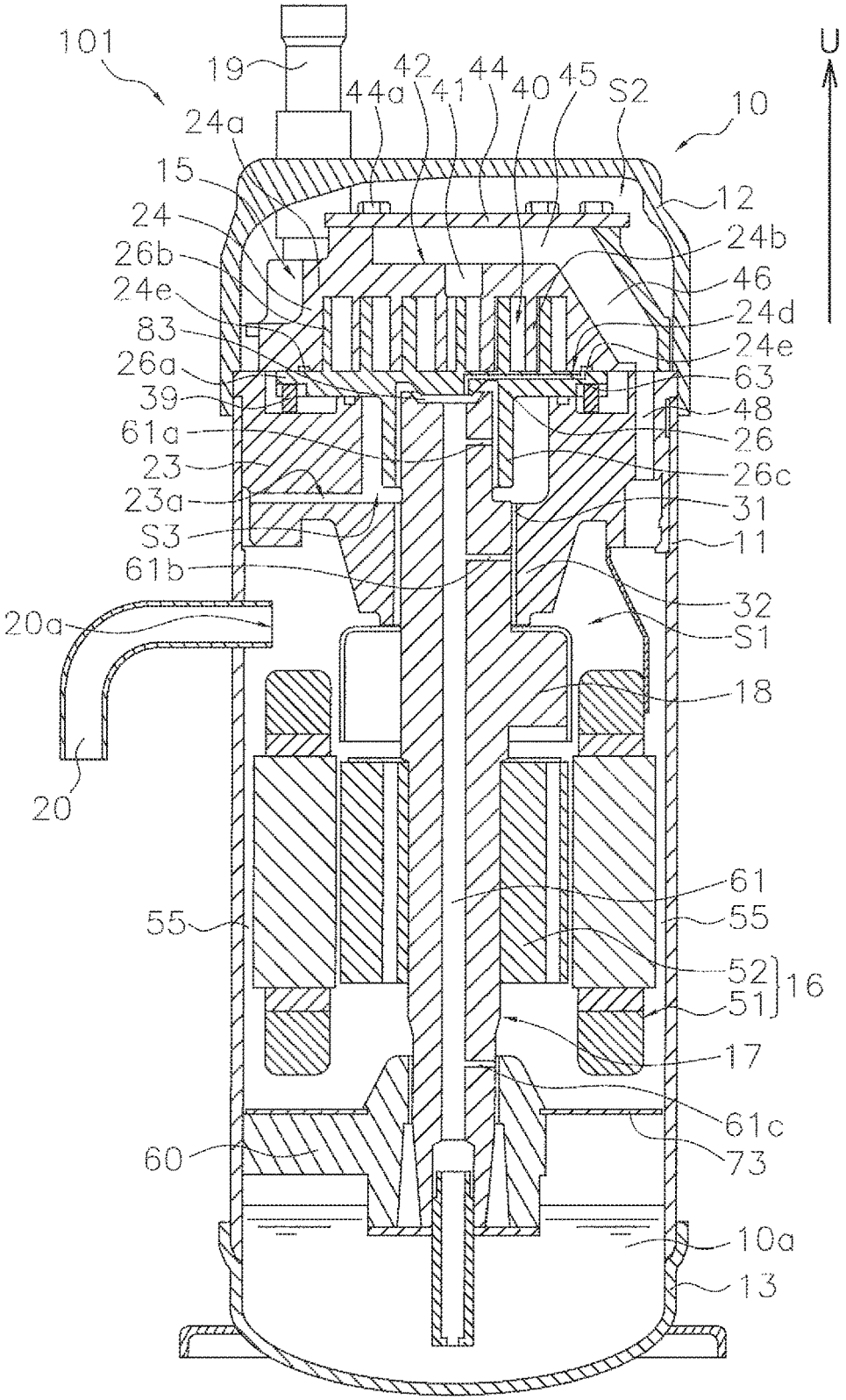
FIG. 1 is a longitudinal sectional view of a scroll compressor pertaining to an embodiment.

The scroll compressor 101 is a high/low pressure dome-type scroll compressor. The scroll compressor 101 compresses refrigerant using two scroll members having spiral-shaped wraps that interfit. FIG. 1 is a longitudinal sectional view of the scroll compressor 101. In FIG. 1, arrow U indicates an upward direction along a vertical direction. The scroll compressor 101 is configured mainly from a casing 10, a compression mechanism 15, a housing 23, an Oldham coupling 39, a drive motor 16, a lower bearing 60, a crankshaft 17, a suction pipe 19, and a discharge pipe 20. Next, the constituent elements of the scroll compressor 101 will be described.

(1-1) Casing

The casing 10 is configured from an open cylinder-shaped barrel casing portion 11, a bowl-shaped top wall portion 12, and a bowl-shaped bottom wall portion 13. The top wall portion 12 is airtightly welded to the upper end portion of the barrel casing portion 11. The bottom wall portion 13 is airtightly welded to the lower end portion of the barrel casing portion 11.

The casing 10 is formed of a rigid member that does not easily become deformed or damaged when there is a change in pressure and/or temperature inside and outside the casing 10. The casing 10 is installed in such a way that the axial direction of the open cylindrical shape of the barrel casing portion 11 lies along the vertical direction.

Inside the casing 10 are housed mainly the compression mechanism 15, the housing 23, the Oldham coupling 39, the drive motor 16, the lower bearing 60, and the crankshaft 17. The suction pipe 19 and the discharge pipe 20 are airtightly welded to wall portions of the casing 10.

In the bottom portion of the casing 10 is formed an oil collection space 10*a* in which lubricating oil is stored. The lubricating oil is refrigerating machine oil that is used to well preserve the lubricity of sliding parts of the compression mechanism 15 and so forth during the operation of the scroll compressor 101.

(1-2) Compression Mechanism

Figure 2:
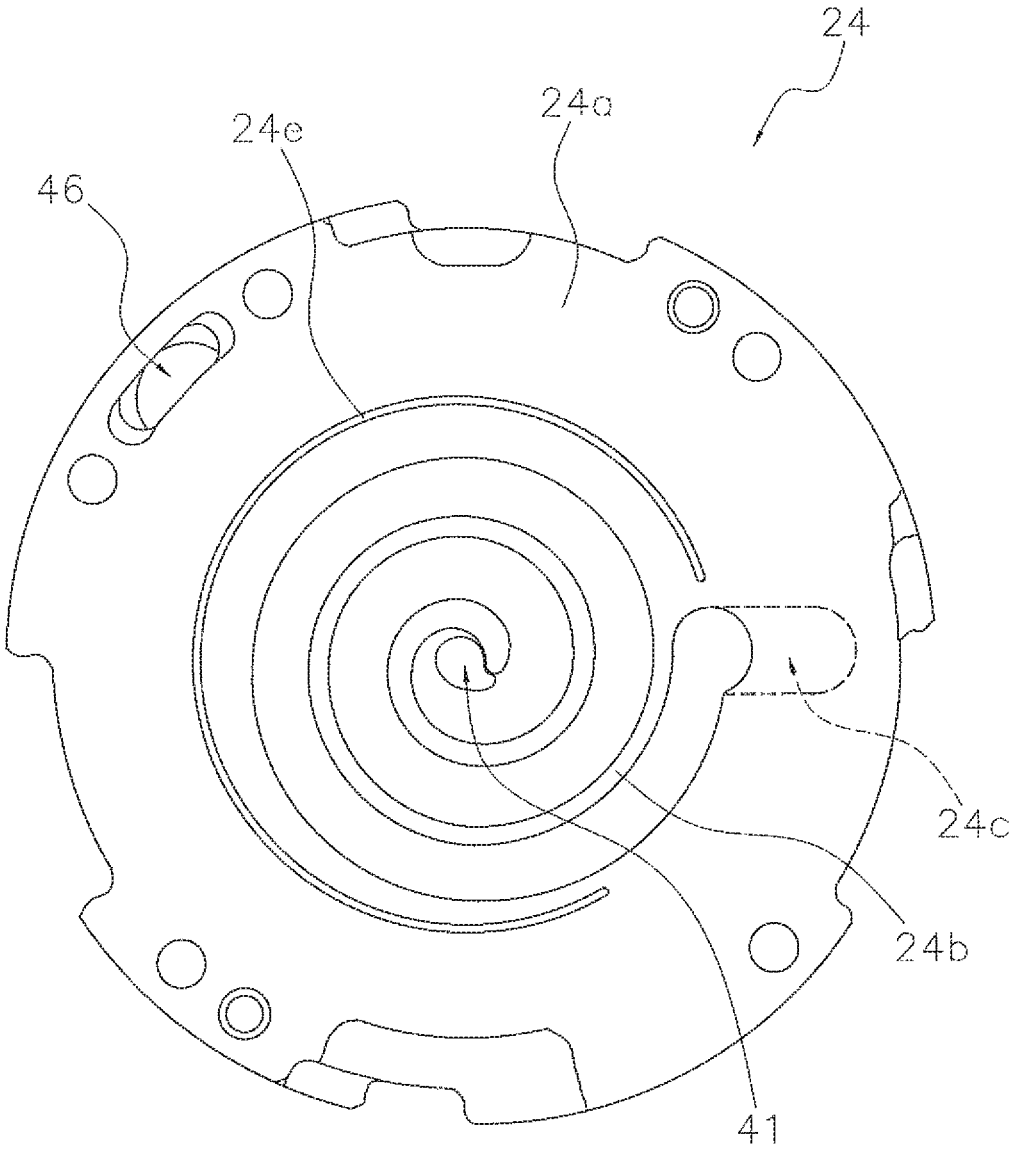
FIG. 2 is a bottom view of a fixed scroll.
Figure 3:
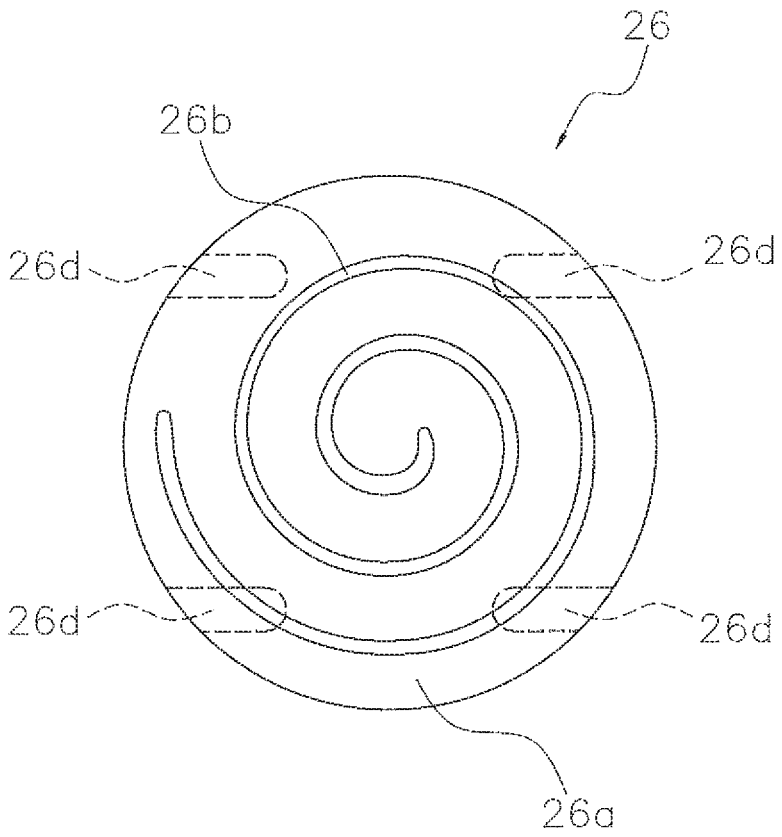
FIG. 3 is a top view of a movable scroll.

The compression mechanism 15 is housed inside the casing 10. The compression mechanism 15 sucks in and compresses low-temperature low-pressure refrigerant gas and discharges high-temperature high-pressure refrigerant gas (hereinafter called "compressed refrigerant"). The compression mechanism 15 is configured mainly from a fixed scroll 24 and a movable scroll 26. The fixed scroll 24 is fixed with respect to the casing 10. The movable scroll 26 performs orbiting movement with respect to the fixed scroll 24. FIG. 2 is a bottom view of the fixed scroll 24 as seen along the vertical direction. FIG. 3 is a top view of the movable scroll 26 as seen along the vertical direction.

(1-2-1) Fixed Scroll

The fixed scroll 24 has a first end plate 24*a* and a first wrap 24*b* that is spiral-shaped and formed upright on the first end plate 24*a*. A main suction hole 24*c* is formed in the first end plate 24*a*. The main suction hole 24*c* is a space that interconnects the suction pipe 19 and later-described compression chambers 40. The main suction hole 24*c* forms a suction space for introducing the low-temperature low-pressure refrigerant gas from the suction pipe 19 to the compression chambers 40. A discharge hole 41 is formed in the central portion of the first end plate 24*a*, and a broad recess portion 42 that communicates with the discharge hole 41 is formed in the upper surface of the first end plate 24*a*. The broad recess portion 42 is a space that is provided recessed in the upper surface of the first end plate 24*a*. A cover 44 is fixed by bolts 44*a* to the upper surface of the fixed scroll 24 in such a way as to close off the broad recessed portion 42. The fixed scroll 24 and the cover 44 are sealed via a gasket (not shown in the drawings). A muffler space 45 that muffles the operating sound of the compression mechanism 15 is formed as a result of the broad recessed portion 42 being covered with the cover 44. A first compressed refrigerant flow passage 46 that communicates with the muffler space 45 and opens to the lower surface of the fixed scroll 24 is formed in the fixed scroll 24. An oil groove 24*e* that is C-shaped as shown in FIG. 2 is formed in the lower surface of the first end plate 24*a*.

(1-2-2) Movable Scroll

Figure 4:
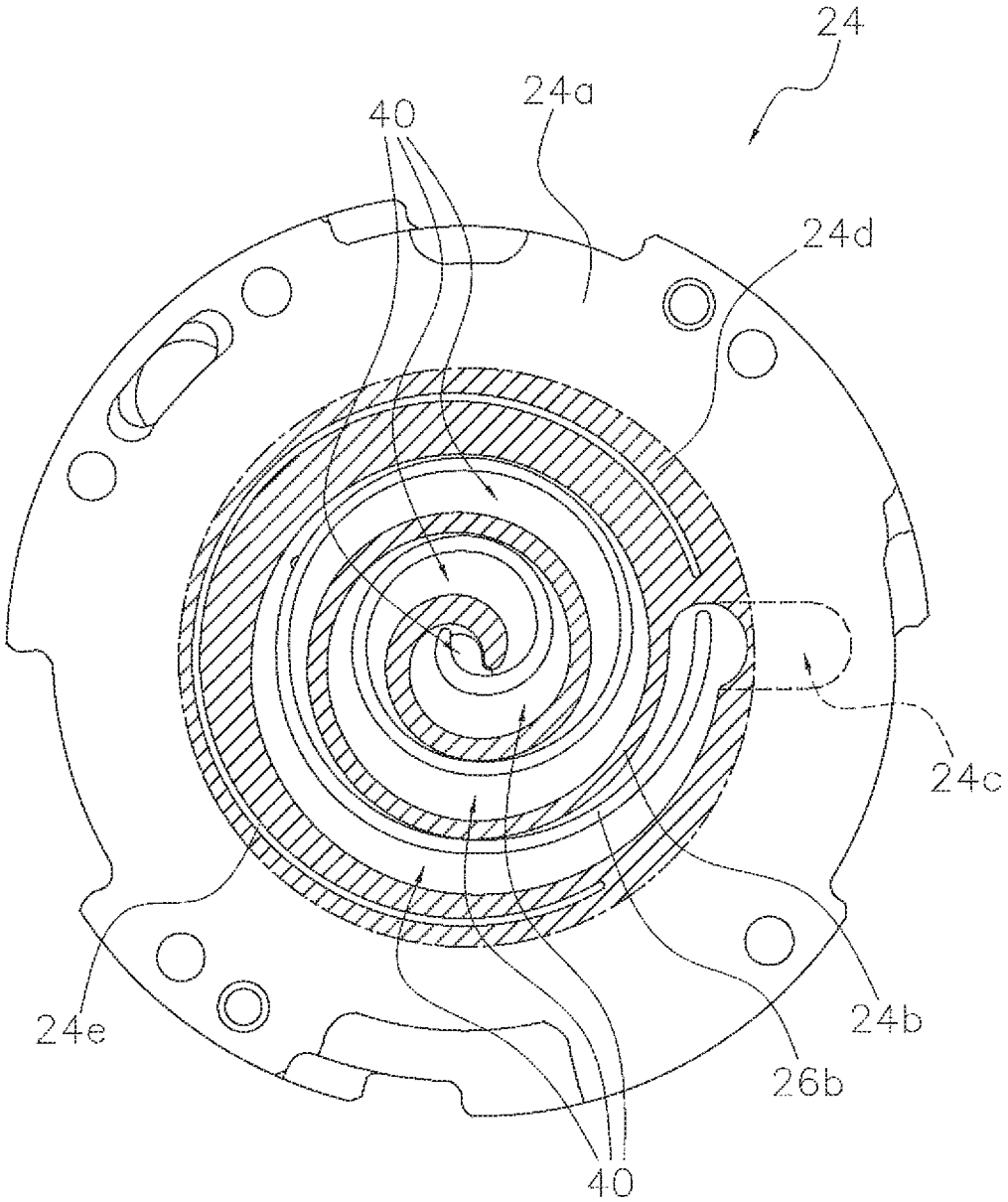
FIG. 4 is a bottom view of the fixed scroll in which a second wrap of the movable scroll and compression chambers are shown.

The movable scroll 26 has a second end plate 26*a* that is disc-shaped and a second wrap 26*b* that is spiral-shaped and formed upright on the second end plate 26*a*. An upper end bearing 26*c* is formed in the central portion of the lower surface of the second end plate 26*a*. An oil feed pore 63 is formed in the movable scroll 26. The oil feed pore 63 allows the outer peripheral portion of the upper surface of the second end plate 26*a* and the space inside the upper end bearing 26*c* to communicate with each other. The fixed scroll 24 and the movable scroll 26 form, as a result of the first wrap 24*b* and the second wrap 26*b* interfitting, compression chambers 40 that are spaces enclosed by the first end plate 24*a*, the first wrap 24*b*, the second end plate 26*a*, and the second wrap 26*b*. The volumes of the compression chambers 40 are gradually reduced by the orbiting movement of the movable scroll 26. During the orbiting of the movable scroll 26, the lower surfaces of the first end plate 24*a* and the first wrap 24*b* of the fixed scroll 24 slide against the upper surfaces of the second end plate 26*a* and the second wrap 26*b* of the movable scroll 26. Hereinafter, the surface of the first end plate 24*a* that slides against the movable scroll 26 will be called a thrust sliding surface 24*d*. FIG. 4 is a bottom view of the fixed scroll 24 in which the second wrap 26*b* of the movable scroll 26 and the compression chambers 40 are shown. In FIG. 4, the region with the hatching represents the thrust sliding surface 24*d*. In FIG. 4, the outer edge of the thrust sliding surface 24*d* represents the path of the outer edge of the second end plate 26*a* of the orbiting movable scroll 26. As shown in FIG. 4, the oil groove 24*e* of the fixed scroll 24 is formed in the lower surface of the first end plate 24*a* in such a way as to fit within the thrust sliding surface 24*d*.

Two pairs of first key grooves 26*d* are formed in the lower surface of the second end plate 26*a*. In FIG. 3, the positions of the first key grooves 26*d* are indicated by dashed lines. When the movable scroll 26 is seen along the vertical direction, the first key grooves 26*d* are formed in positions the same distance away from the center of the second end plate 26*a*. The first key grooves 26*d* are grooves into which first key portions 39*b* of the Oldham coupling 39 are fitted.

(1-3) Housing

The housing 23 is disposed under the compression mechanism 15. The outer peripheral surface of the housing 23 is airtightly joined to the inner peripheral surface of the barrel casing portion 11. Because of this, the inside space of the casing 10 is partitioned into a high-pressure space S1 under the housing 23 and an upper space S2 that is a space above the housing 23. The housing 23 has the fixed scroll 24 mounted on it and, together with the fixed scroll 24, sandwiches the movable scroll 26. A second compressed refrigerant flow passage 48 is formed in, so as to run through in the vertical direction, the outer peripheral portion of the housing 23. The second compressed refrigerant flow passage 48 communicates with the first compressed refrigerant flow passage 46 at the upper surface of the housing 23 and communicates with the high-pressure space S1 at the lower surface of the housing 23.

A crank chamber S3 is provided recessed in the upper surface of the housing 23. A housing through hole 31 is formed in the housing 23. The housing through hole 31 runs through the housing 23 in the vertical direction from the central portion of the bottom surface of the crank chamber S3 to the central portion of the lower surface of the housing 23. Hereafter, the portion that is part of the housing 23 and in which the housing through hole 31 is formed will be called an upper bearing 32. In the housing 23 is formed an oil return passageway 23*a* that allows the high-pressure space S1 in the neighborhood of the inner peripheral surface of the casing 10 and the crank chamber S3 to communicate with each other.

A pair of second key grooves 23*d* is formed in the upper surface of the housing 23. When the housing 23 is seen along the vertical direction, the second key grooves 23*d* are formed in positions the same distance away from the center of the housing through hole 31. The second key grooves 23*d* are grooves into which second key portions 39*c* of the Oldham coupling 39 are fitted.

(1-4) Oldham Coupling

Figure 5:
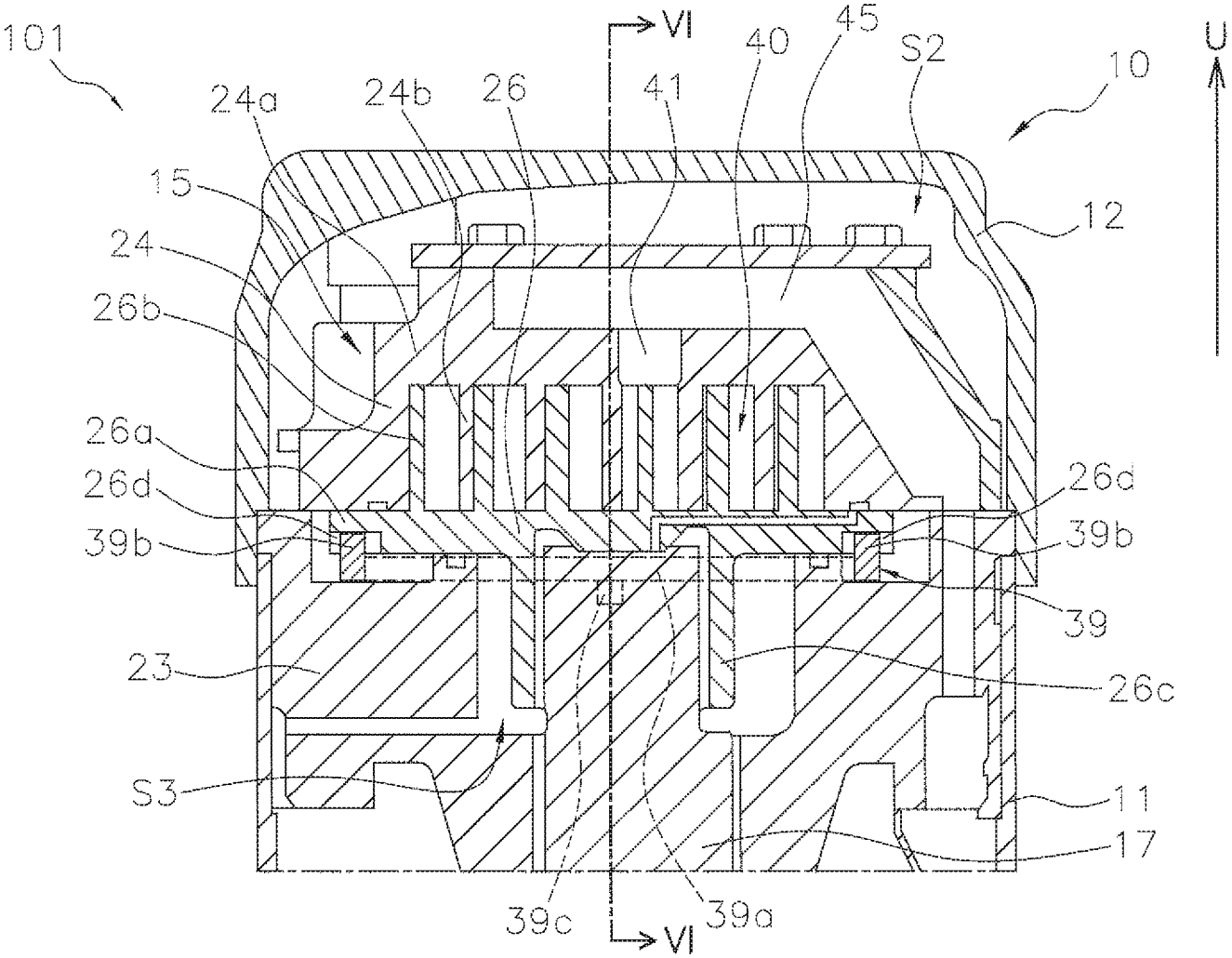
FIG. 5 is an enlarged view of the area around an Oldham coupling of FIG. 1.
Figure 6:
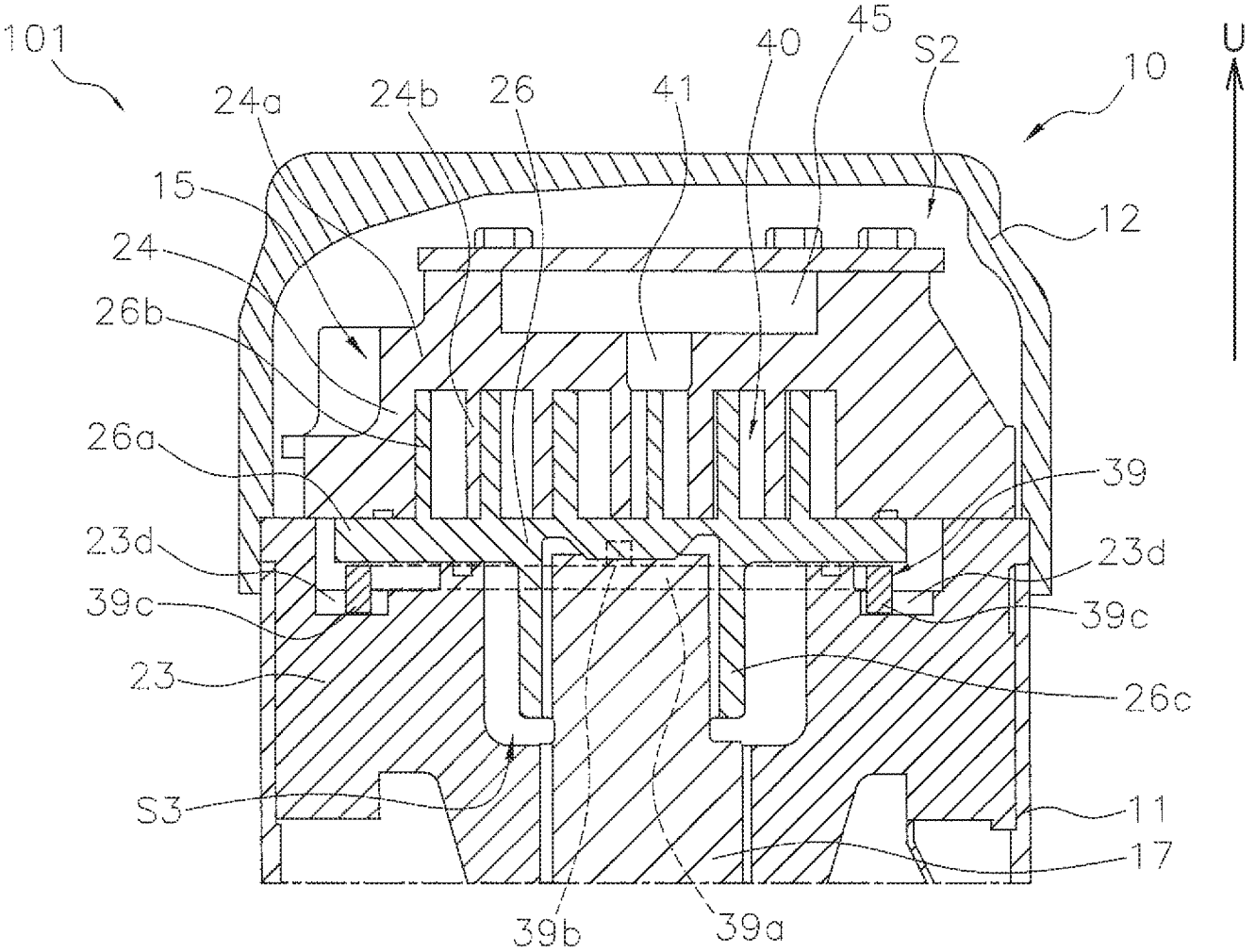
FIG. 6 is a sectional view along line segment VI-VI of FIG. 5.
Figure 7:
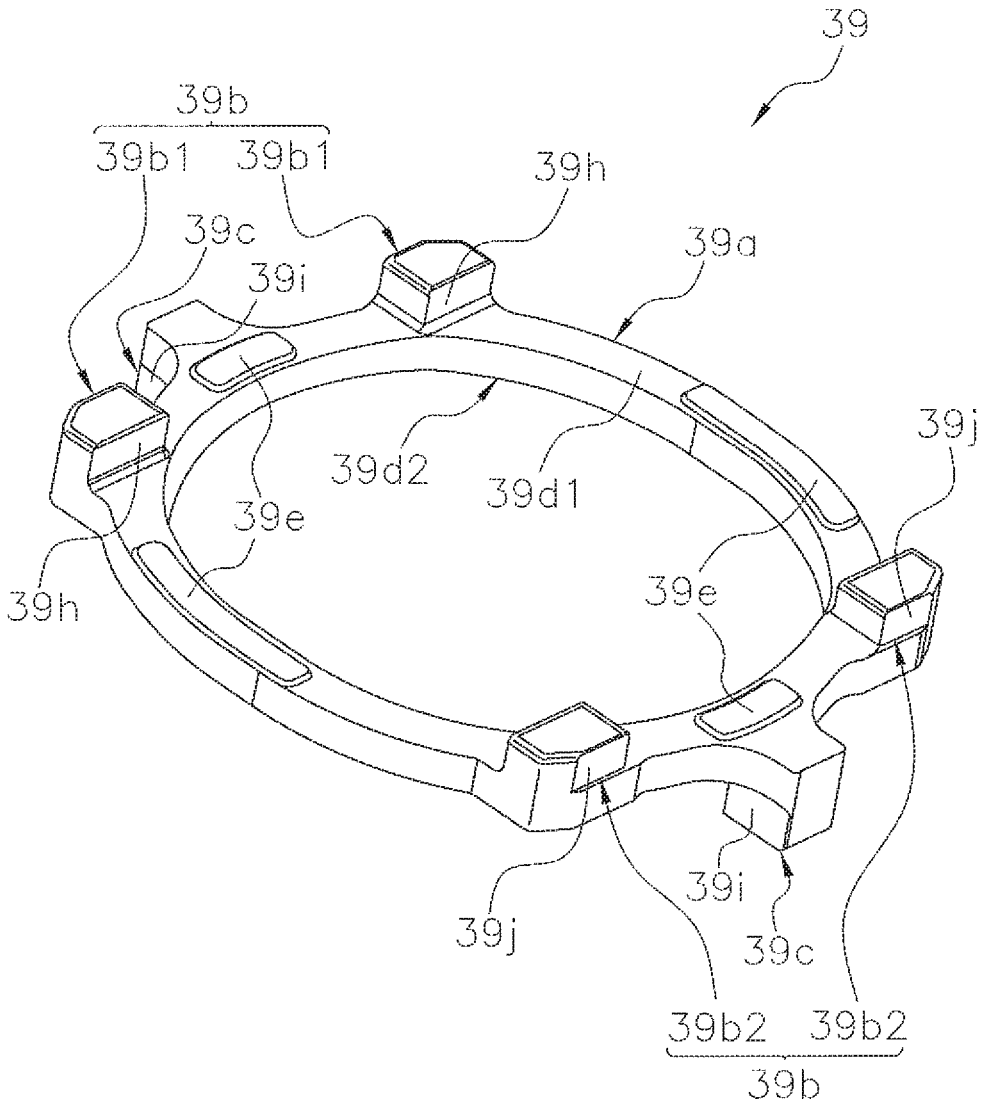
FIG. 7 is a perspective view of the Oldham coupling.
Figure 8:
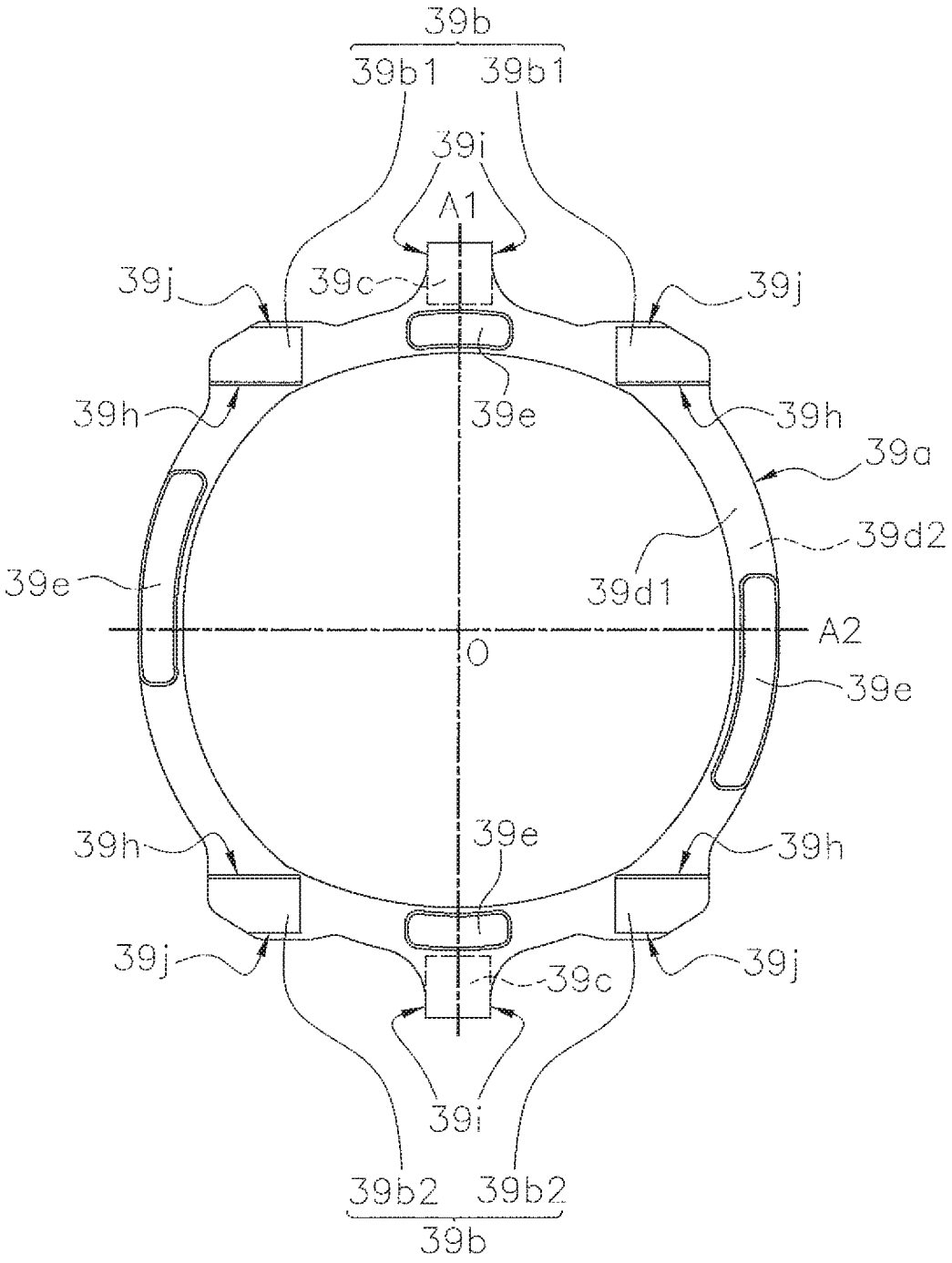
FIG. 8 is a top view of the Oldham coupling.

The Oldham coupling 39 is a member for preventing self-rotation of the orbiting movable scroll 26. FIG. 5 is an enlarged view of the area around the Oldham coupling 39 of FIG. 1. FIG. 6 is a sectional view along line segment VI-VI of FIG. 5. As shown in FIGS. 5 and 6, the Oldham coupling 39 is installed between the movable scroll 26 and the housing 23. FIG. 7 is a perspective view of the Oldham coupling 39. FIG. 8 is a top view of the Oldham coupling 39.

The Oldham coupling 39 is an annular member having mainly an annular body portion 39*a*, two pairs of first key portions 39*b*, and a pair of second key portions 39*c*.

The annular body portion 39*a* has a first horizontal surface 39*d*1 and a second horizontal surface 39*d*2 that oppose each other. The first horizontal surface 39*d*1 and the second horizontal surface 39*d*2 are surfaces parallel to the horizontal plane. The first horizontal surface 39*d*1 is positioned higher than the second horizontal surface 39*d*2. In FIGS. 7 and 8, the second horizontal surface 39*d*2 is a surface on the reverse side of the first horizontal surface 39*d*1. On the first horizontal surface 39*d*1 are formed plural sliding raised portions 39*e*. The upper surfaces of the sliding raised portions 39*e* are parallel to the first horizontal surface 39*d*1. When the Oldham coupling 39 is seen along the vertical direction, the inner peripheral surface of the annular body portion 39*a* has a circular arc shape.

The first key portions 39*b* are raised portions that project upward from the first horizontal surface 39*d*1. The first key portions 39*b* are fitted into the first key grooves 26*d* of the movable scroll 26.

The second key portions 39*c* are raised portions that project downward from the second horizontal surface 39*d*2. The second key portions 39*c* are fitted into the second key grooves 23*d* of the housing 23. In FIG. 8, the positions of the second key portions 39*c* are indicated by dashed lines.

FIG. 8 shows a first axis A1 and a second axis A2 that are parallel to the horizontal plane. The first axis A1 and the second axis A2 pass through a center of gravity O of the Oldham coupling 39 and are orthogonal to each other. The four first key portions 39*b* are formed one each in four regions partitioned by the first axis A1 and the second axis A2. The two second key portions are formed one each in two regions partitioned by the second axis A2. Hereinafter, as needed, the four first key portions 39*b* will be differentiated into a pair of first key portions 39*b*1 and a pair of first key portions 39*b*2 and described as shown in FIG. 7 and FIG. 8.

The pair of first key portions 39*b*1 are formed in symmetrical positions across the first axis A1. The pair of first key portions 39*b*2 are formed in symmetrical positions across the first axis A1. The pair of first key portions 39*b*1 and the pair of first key portions 39*b*2 are formed in symmetrical positions across the second axis A2.

The pair of second key portions 39*c* are formed in symmetrical positions across the second axis A2. Each second key portion 39*c* is formed in a position on the first axis A1 in which it is symmetrical with respect to the first axis A1.

The first key portions 39*b* have first sliding surfaces 39*h* and first guide surfaces 39*j*. The first sliding surfaces 39*h* and the first guide surfaces 39*j* are side surfaces of the first key portions 39*b* and are surfaces that are parallel to the second axis A2. Of the first sliding surfaces 39*h* and the first guide surfaces 39*j*, the first sliding surfaces 39*h* are the surfaces closer to the center of gravity O of the Oldham coupling 39, and the first guide surfaces 39*j* are the surfaces farther away from the center of gravity O of the Oldham coupling 39. The first sliding surfaces 39*h* are surfaces that slide against the inner peripheral surfaces of the first key grooves 26*d* along the second axis A2. The first sliding surfaces 39*h* are surfaces that receive surface pressure from the movable scroll 26.

The second key portions 39*c* have second sliding surfaces 39*i* that are side surfaces parallel to the first axis A1. The second sliding surfaces 39*i* are a pair of side surfaces of each second key portion 39*c* and are surfaces that are parallel to the first axis A1. The second sliding surfaces 39*i* are surfaces that slide against the inner peripheral surfaces of the second key grooves 23*d* along the first axis A1. The second sliding surfaces 39*i* are surfaces that receive surface pressure from the housing 23.

The Oldham coupling 39 is relatively movable with respect to the housing 23 along the first axis A1 and is relatively movable with respect to the movable scroll 26 along the second axis A2. As the Oldham coupling 39 relatively moves with respect to the movable scroll 26, the upper surfaces of the sliding raised portions 39*e* of the Oldham coupling 39 slide against the lower surface of the second end plate 26*a* of the movable scroll 26.

Figure 9:
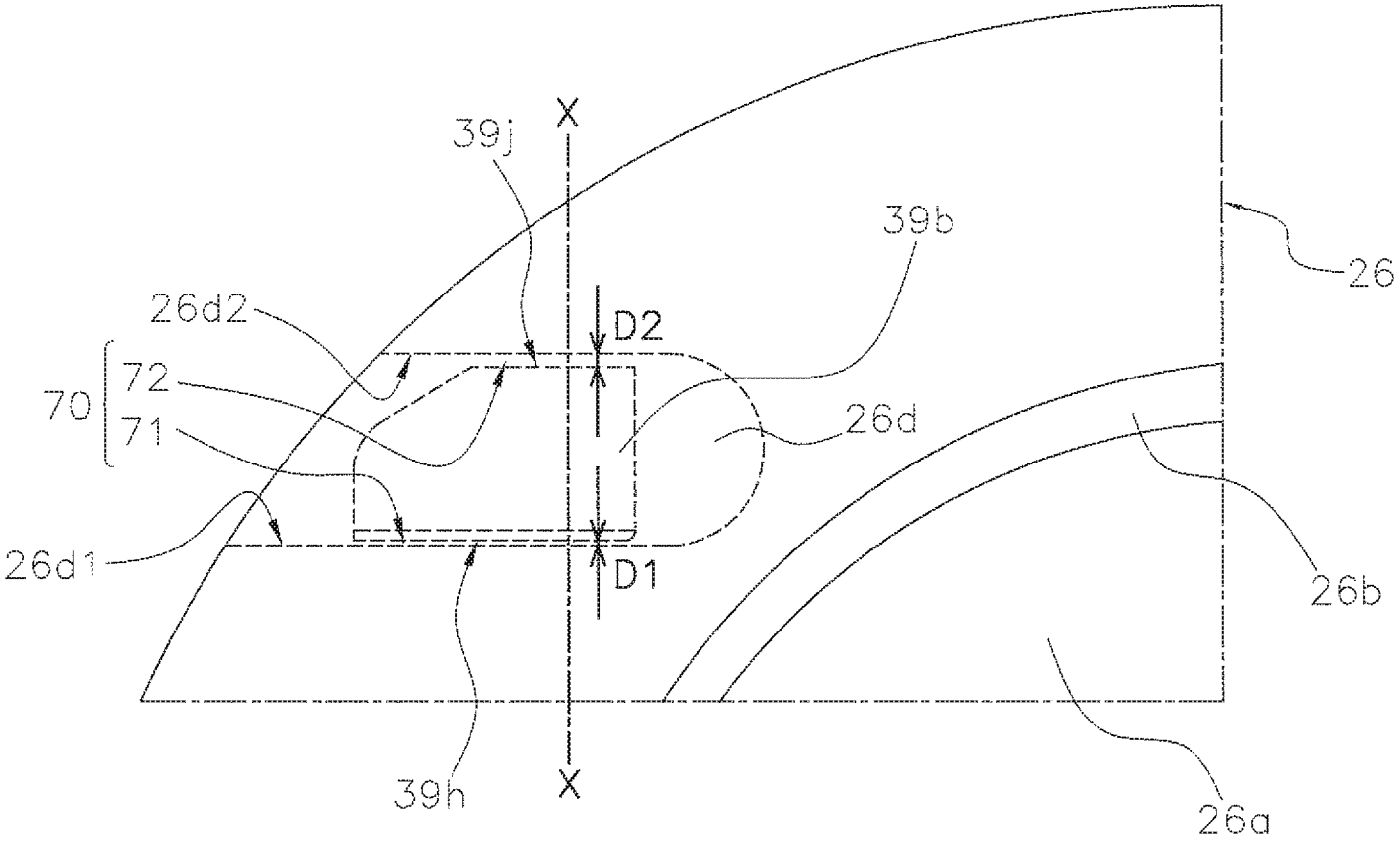
FIG. 9 is a top view showing a first key portion fitted into an upper left first key groove shown in FIG. 3.
Figure 10:
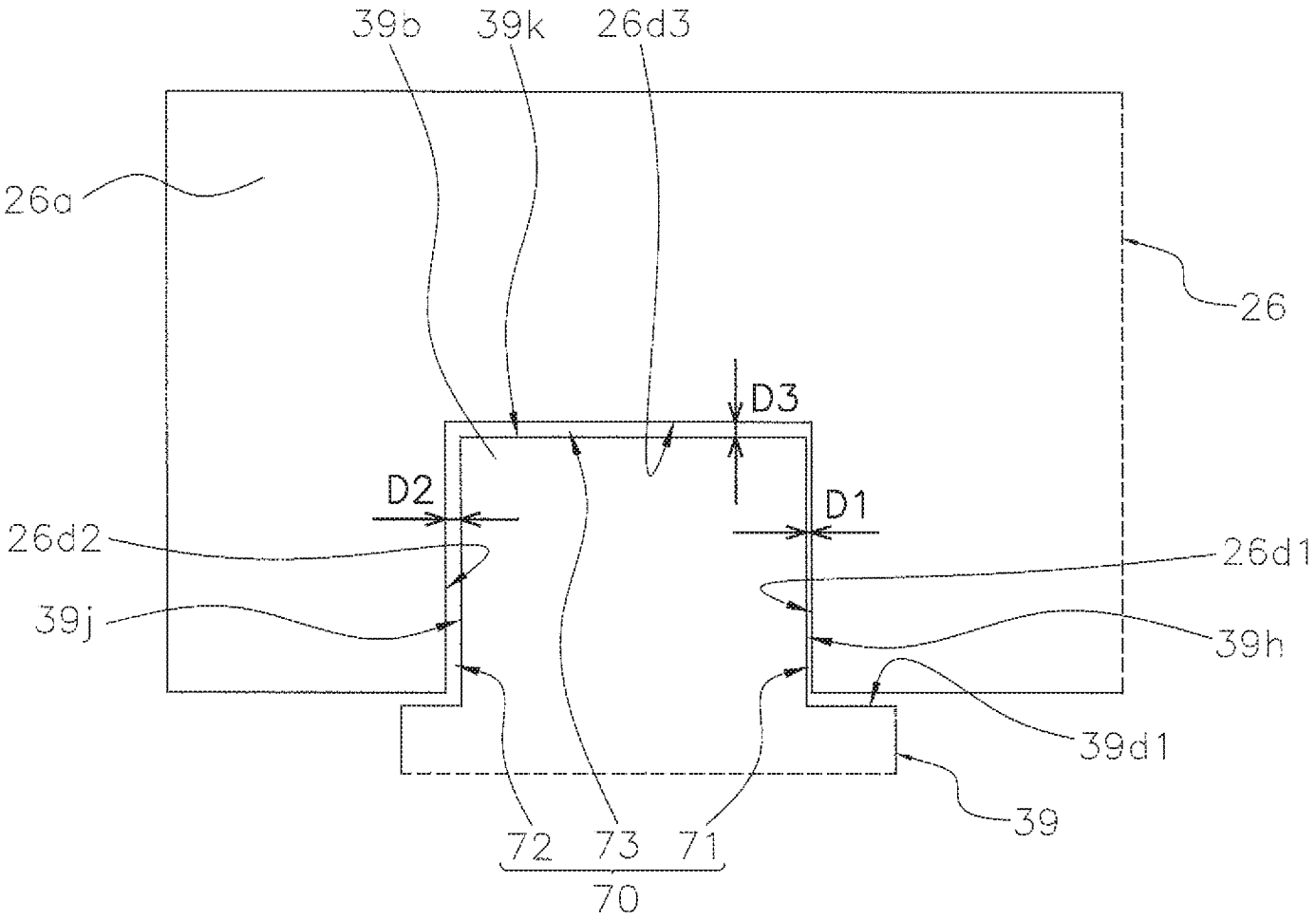
FIG. 10 is a sectional view along line segment X-X of FIG. 9.

FIG. 9 is a top view showing the first key portion 39*b* fitted into the upper left first key groove 26*d* shown in FIG. 3. FIG. 10 is a sectional view along line segment X-X of FIG. 9. The first sliding surfaces 39*h* of the first key portions 39*b* are surfaces that oppose first key groove inner surfaces 26*d*1 of the first key grooves 26*d*. The first guide surfaces 39*j* of the first key portions 39*b* are surfaces that oppose first key groove outer surfaces 26*d*2 of the first key grooves 26*d*. The first key groove inner surfaces 26*d*1 and the first key groove outer surfaces 26*d*2 are surfaces that are parallel to the second axis A2.

As shown in FIG. 10, the first key portions 39*b* have first upper end surfaces 39*k*. The first upper end surfaces 39*k* are surfaces that oppose first key groove bottom surfaces 26*d*3 of the first key grooves 26*d*. The first key groove bottom surfaces 26*d*3 correspond to bottom surfaces of the first key grooves 26*d*. However, because the first key grooves 26*d* are grooves formed in the lower surface of the movable scroll 26, as shown in FIG. 10, the first key groove bottom surfaces 26*d*3 are connected to upper ends of the first key groove inner surfaces 26*d*1 and the first key groove outer surfaces 26*d*2.

As shown in FIG. 9 and FIG. 10, spaces called key gaps 70 exist between the outer peripheral surfaces of the first key portions 39*b* and the inner peripheral surfaces of the first key grooves 26*d*. The key gaps 70 have mainly first gaps 71, second gaps 72, and third gaps 73. The first gaps 71 are gaps between the first sliding surfaces 39*h* of the first key portions 39*b* and the first key groove inner surfaces 26*d*1 of the first key grooves 26*d*. The second gaps 72 are gaps between the first guide surfaces 39*j* of the first key portions 39*b* and the first key groove outer surfaces 26*d*2 of the first key grooves 26*d*. The third gaps 73 are gaps between the first upper end surfaces 39*k* of the first key portions 39*b* and the first key groove bottom surfaces 26*d*3 of the first key grooves 26*d*.

A dimension D1 of the first gaps 71 is 15 μm to 50 μm. A dimension D2 of the second gaps 72 is 200 μm to 1000 μm. A dimension D3 of the third gaps 73 is 200 μm to 1000 μm. The dimension D1 of the first gaps 71 is the distance between the first sliding surfaces 39*h* and the first key groove inner surfaces 26*d*1 in a direction parallel to the first axis A1. The dimension D2 of the second gaps 72 is the distance between the first guide surfaces 39*j* and the first key groove outer surfaces 26*d*2 in a direction parallel to the first axis A1. The dimension D3 of the third gaps 73 is the distance between the first upper end surfaces 39*k* and the first key groove bottom surfaces 26*d*3 in the vertical direction. The second gaps 72 are wider than the first gaps 71. That is, the dimension D2 of the second gaps 72 is greater than the dimension D1 of the first gaps 71.

(1-5) Drive Motor

The drive motor 16 is a brushless DC motor disposed under the housing 23. The drive motor 16 has mainly a stator 51 and a rotor 52. The stator 51 is an open cylinder-shaped member fixed to the inner peripheral surface of the casing 10. The rotor 52 is a solid cylinder-shaped member disposed inside the stator 51. An air gap is formed between the inner peripheral surface of the stator 51 and the outer peripheral surface of the rotor 52.

Plural core cuts are formed in the outer peripheral surface of the stator 51. The core cuts are grooves formed in the vertical direction ranging from the upper end surface to the lower end surface of the stator 51. The core cuts are formed at predetermined intervals along the circumferential direction of the stator 51. The core cuts form motor cooling passageways 55 that extend in the vertical direction between the barrel casing portion 11 and the stator 51.

The rotor 52 is coupled to the crankshaft 17. The crankshaft 17 runs in the vertical direction through the rotational center of the rotor 52. The rotor 52 is connected via the crankshaft 17 to the compression mechanism 15.

(1-6) Lower Bearing

The lower bearing 60 is disposed under the drive motor 16. The outer peripheral surface of the lower bearing 60 is airtightly joined to the inner peripheral surface of the casing 10. The lower bearing 60 supports the crankshaft 17. An oil separation plate 73 is attached to the lower bearing 60. The oil separation plate 73 is a flat plate-shaped member housed inside the casing 10. The oil separation plate 73 is fixed to the upper end surface of the lower bearing 60.

(1-7) Crankshaft

The crankshaft 17 is housed inside the casing 10. The crankshaft 17 is disposed in such a way that its axial direction lies along the vertical direction. The axial center of the upper end portion of the crankshaft 17 is slightly eccentric with respect to the axial center of the portion excluding the upper end portion. The crankshaft 17 has a counterweight 18. The counterweight 18 is tightly fixed to the crankshaft 17 at a height position under the housing 23 and above the drive motor 16. The crankshaft 17 runs in the vertical direction through the rotational center of the rotor 52 and is coupled to the rotor 52. The upper end portion of the crankshaft 17 is fitted into the upper end bearing 26*c*, whereby the crankshaft 17 is connected to the movable scroll 26. The crankshaft 17 is supported by the upper bearing 32 and the lower bearing 60.

The crankshaft 17 has inside a main oil feed passage 61 that extends in the axial direction of the crankshaft 17. The upper end of the main oil feed passage 61 communicates with an oil chamber 83 formed by the upper end surface of the crankshaft 17 and the lower surface of the second end plate 26*a*. The oil chamber 83 communicates with the thrust sliding surface 24*d* and the oil groove 24*e* via the oil feed pore 63 in the second end plate 26*a* and finally communicates with the low-pressure space S2 via the compression chambers 40. The lower end of the main oil feed passage 61 is immersed in the lubricating oil in the oil collection space 10*a*.

The crankshaft 17 has a first auxiliary oil feed passage 61*a*, a second auxiliary oil feed passage 61*b*, and a third auxiliary oil feed passage 61*c* that branch from the main oil feed passage 61. The first auxiliary oil feed passage 61*a*, the second auxiliary oil feed passage 61*b*, and the third auxiliary oil feed passage 61*c* extend in the horizontal direction. The first auxiliary oil feed passage 61*a* opens to the sliding surfaces of the crankshaft 17 and the upper end bearing 26*c* of the movable scroll 26. The second auxiliary oil feed passage 61*b* opens to the sliding surfaces of the crankshaft 17 and the upper bearing 32 of the housing 23. The third auxiliary oil feed passage 61*b* opens to the sliding surfaces of the crankshaft 17 and the lower bearing 60.

(1-8) Suction Pipe

The suction pipe 19 is a pipe for introducing the refrigerant in the refrigerant circuit from the outside of the casing 10 to the compression mechanism 15. The suction pipe 19 is airtightly fitted into the top wall portion 12 of the casing 10. The suction pipe 19 runs in the vertical direction through the upper space S2, and its inner end portion is fitted into the main suction hole 24*c* in the fixed scroll 24.

(1-9) Discharge Pipe

The discharge pipe 20 is a pipe for discharging the compressed refrigerant from the high-pressure space S1 to the outside of the casing 10. The discharge pipe 20 is airtightly fitted into the barrel casing portion 11 of the casing 10. The discharge pipe 20 runs in the horizontal direction through the high-pressure space S1. Inside the casing 10, an open portion 20*a* of the discharge pipe 20 is positioned in the neighborhood of the housing 23.

(2) Operation of Scroll Compressor

The operation of the scroll compressor 101 will be described. First, the flow of the refrigerant circulating through the refrigerant circuit equipped with the scroll compressor 101 will be described. Next, the flow of the lubricating oil inside the scroll compressor 101 will be described.

(2-1) Flow of Refrigerant

When the driving of the drive motor 16 starts, the rotor 52 begins to rotate and the crankshaft 17 fixed to the rotor 52 begins axially rotating. The axial rotational movement of the crankshaft 17 is transmitted via the upper end bearing 26*c* to the movable scroll 26. The axial center of the upper end portion of the crankshaft 17 is eccentric with respect to the axial center of the axial rotational movement of the crankshaft 17.

The movable scroll 26 is engaged with the housing 23 via the Oldham coupling 39. When the crankshaft 17 rotates, the first key portions 39*b* of the Oldham coupling 39 slide along the second axis A2 inside the first key grooves 26*d* of the movable scroll 26, and the second key portions 39*c* of the Oldham coupling 39 slide along the first axis A1 inside the second key grooves 23*d* of the housing 23. Because of this, the movable scroll 26 performs orbiting movement with respect to the fixed scroll 24 without self-rotating.

The low-temperature low-pressure refrigerant before being compressed is supplied from the suction pipe 19 via the main suction hole 24*c* to the compression chambers 40 of the compression mechanism 15. Because of the orbiting movement of the movable scroll 26, the compression chambers 40 move from the outer peripheral portion to the central portion of the fixed scroll 24 while their volumes are gradually decreased. As a result, the refrigerant in the compression chambers 40 is compressed and becomes compressed refrigerant. The compressed refrigerant is discharged from the discharge hole 41 to the muffler space 45 and thereafter is discharged via the first compressed refrigerant flow passage 46 and the second compressed refrigerant flow passage 48 to the high-pressure space S1. Thereafter, the compressed refrigerant descends through a motor cooling passageway 55 and reaches the high-pressure space S1 under the drive motor 16. Thereafter, the compressed refrigerant reverses its flow direction and ascends through another motor cooling passageway 55 and the air gap in the drive motor 16. Finally, the compressed refrigerant is discharged from the discharge pipe 20 to the outside of the scroll compressor 101.

(2-2) Flow of Lubricating Oil

When the driving of the drive motor 16 starts, the rotor 52 begins to rotate and the crankshaft 17 fixed to the rotor 52 begins axially rotating. When the compression mechanism 15 is driven by the axial rotation of the crankshaft 17 and the compressed refrigerant is discharged to the high-pressure space S1, the pressure inside the high-pressure space S1 increases. The lower end of the main oil feed passage 61 communicates with the oil collection space 10*a* inside the high-pressure space S1. The upper end of the main oil feed passage 61 communicates with the low-pressure space S2 via the oil chamber 83 and the oil feed pore 63. Because of this, differential pressure occurs between the upper end and the lower end of the main oil feed passage 61. As a result, the lubricating oil stored in the oil collection space 10*a* is sucked by the differential pressure from the lower end of the main oil feed passage 61 and ascends through the inside of the main oil feed passage 61 to the oil chamber 83.

Most of the lubricating oil ascending through the main oil feed passage 61 is sequentially distributed to the third auxiliary oil feed passage 61*c*, the second auxiliary oil feed passage 61*b*, and the first auxiliary oil feed passage 61*a*. The lubricating oil flowing through the third auxiliary oil feed passage 61*c* lubricates the sliding surfaces of the crankshaft 17 and the lower bearing 60 and thereafter flows into the high-pressure space S1 and returns to the oil collection space 10*a*. The lubricating oil flowing through the second auxiliary oil feed passage 61*b* lubricates the sliding surfaces of the crankshaft 17 and the upper bearing 32 of the housing 23 and thereafter flows into the high-pressure space S1 and the crank chamber S3. The lubricating oil that has flowed into the high-pressure space S1 returns to the oil collection space 10*a*. The lubricating oil that has flowed into the crank chamber S3 flows via the oil return passageway 23*a* in the housing 23 to the high-pressure space S1 and returns to the oil collection space 10*a*. The lubricating oil flowing through the first auxiliary oil feed passage 61*a* lubricates the sliding surfaces of the crankshaft 17 and the upper end bearing 26*c* of the movable scroll 26 and thereafter flows into the crank chamber S3 and returns via the high-pressure space S1 to the oil collection space 10*a*.

The lubricating oil that has ascended through the inside of the main oil feed passage 61 to the upper end and has reached the oil chamber 83 flows through the oil feed pore 63 and is supplied to the oil groove 24*e* by the differential pressure. Some of the lubricating oil that has been supplied to the oil groove 24*e* leaks out to the low-pressure space S2 and the compression chambers 40 while sealing the thrust sliding surface 24*d*. At this time, the high-temperature lubricating oil that has leaked out heats the low-temperature refrigerant gas present in the low-pressure space S2 and the compression chambers 40. Furthermore, the lubricating oil that has leaked out to the compression chambers 40 becomes mixed in, as minute oil droplets, with the compressed refrigerant. The lubricating oil that has been mixed in with the compressed refrigerant travels the same path as the compressed refrigerant and is discharged from the compression chambers 40 to the high-pressure space S1. Thereafter, the lubricating oil descends together with the compressed refrigerant through the motor cooling passageways 55 and thereafter hits the oil separation plate 73. The lubricating oil sticking to the oil separation plate 73 falls through the high-pressure space S1 and returns to the oil collection space 10*a*.

(3) Characteristics of Scroll Compressor 3-1

In the scroll compressor 101, the Oldham coupling 39 has the first key portions 39*b* that slide against the movable scroll 26 and the second key portions 39*c* that slide against the housing 23. The first key portions 39*b* have the first sliding surfaces 39*h* and the first guide surfaces 39*j* that move along the second axis A2. The first sliding surfaces 39*h* are surfaces that are closer to the center of gravity O of the Oldham coupling 39 than the first guide surfaces 39*j*. The first sliding surfaces 39*h* are surfaces that slide against the first key groove inner surfaces 26*d*1 of the first key grooves 26*d* of the movable scroll 26.

The first gaps 71 are formed between the first sliding surfaces 39*h* of the first key portions 39*b* and the first key groove inner surfaces 26*d*1 of the first key grooves 26*d*. The second gaps 72 are formed between the first guide surfaces 39*j* of the first key portions 39*b* and the first key groove outer surfaces 26*d*2 of the first key grooves 26*d*. The first gaps 71 and the second gaps 72 are spaces in which the lubricating oil supplied to the first key grooves 26*d* is held. The lubricating oil inhibits seizure between the first sliding surfaces 39*h* and the first key groove inner surfaces 26*d*1 that slide against each other.

The second gaps 72 are wider than the first gaps 71, so the second gaps 72 hold the lubricating oil supplied to the first key grooves 26*d* more easily than the first gaps 71 do. Because of this, some of the lubricating oil held in the second gaps 72 is supplied to the first gaps 71 via the key gaps 70 between the outer peripheral surfaces of the first key portions 39*b* and the inner peripheral surfaces of the first key grooves 26*d*. For that reason, even if the lubricating oil present in the first gaps 71 becomes deficient, some of the lubricating oil present in the second gaps 72 is supplied to the first gaps 71, so seizure of the first sliding surfaces 39*h* of the first key portions 39*b* is inhibited. Consequently, the scroll compressor 101 has high reliability by inhibiting seizure of the sliding surfaces of the Oldham coupling 39 and the movable scroll 26.

3-2

In the scroll compressor 101, the dimension D1 of the first gaps 71 is 15 μm to 50 μm. The dimension D1 of the first gaps 71 is narrow enough to sufficiently inhibit chattering of the sliding Oldham coupling 39 and wide enough to hold a quantity of lubricating oil with which seizure of the first sliding surfaces 39*h* is sufficiently inhibited. If the dimension D1 of the first gaps 71 is too wide, sometimes the Oldham coupling 39 sliding along the second axis A2 vibrates in the direction of the first axis A1 and the Oldham coupling 39 chatters. Furthermore, if the dimension D1 of the first gaps 71 is too narrow, there is the concern that the lubricating oil will not be sufficiently held in the first gaps 71 and that seizure of the first sliding surfaces 39*h* will occur. Consequently, by setting the dimension D1 of the first gaps 71 to an appropriate range, vibration of the Oldham coupling 39 is inhibited and the occurrence of seizure of the first sliding surfaces 39*h* of the first key portions 39*b* caused by the lubricating oil not being sufficiently supplied to the first gaps 71 is inhibited.

3-3

In the scroll compressor 101, the dimension D2 of the second gaps 72 is 200 μm to 1000 μm. The dimension D2 of the second gaps 72 is greater than the dimension D1 of the first gaps 71, so the second gaps 72 can hold a larger quantity of the lubricating oil than the first gaps 71. Because of this, some of the lubricating oil held in the second gaps 72 is supplied to the first gaps 71 via the key gaps 70 between the outer peripheral surfaces of the first key portions 39*b* and the inner peripheral surfaces of the first key grooves 26*d*. Consequently, by setting the dimension D2 of the second gaps 72 to an appropriate range, the occurrence of seizure of the first sliding surfaces 39*h* of the first key portions 39*b* caused by the lubricating oil not being sufficiently supplied to the first gaps 71 is inhibited.

3-4

In the scroll compressor 101, the two pairs of first key portions 39*b* are provided one each in four regions partitioned by the first axis A1 and the second axis A2. That is, when the Oldham coupling 39 is seen in a top view, the four first key portions 39*b* are disposed as far away from each other as possible. For that reason, the surface pressure that acts on the first sliding surfaces 39*h* of the first key portions 39*b* is equally dispersed between the four first key portions 39*b*. Consequently, the occurrence of seizure at only the first sliding surfaces 39*h* of some of the first key portions 39*b* is inhibited.

3-5

In the scroll compressor 101, the pair of second key portions 39*c* are provided on the first axis A1 across the second axis A2. That is, when the Oldham coupling 39 is seen in a top view, the two second key portions 39*c* are disposed as far away from each other as possible. For that reason, the surface pressure that acts on the sliding surfaces of the second key portions 39*c* is equally dispersed between the two second key portions 39*c*. Consequently, the occurrence of seizure at only the sliding surfaces of some of the second key portions 39*c* is inhibited.

(4) Example Modifications

An embodiment of the invention has been described above, but the specific configurations of the invention can be changed in a range that does not depart from the spirit of the invention. Example modifications applicable to the embodiment of the invention will be described below.

(4-1) Example Modification A

In the embodiment, as shown in FIG. 8, the Oldham coupling 39 has mainly the annular body portion 39*a*, the two pairs of first key portions 39*b*, and the pair of second key portions 39*c*. The two pairs of first key portions 39*b* comprise the pair of first key portions 39*b*1 and the pair of first key portions 39*b*2. The pair of first key portions 39*b*1 are formed in symmetrical positions across the first axis A1. The pair of first key portions 39*b*2 are formed in symmetrical positions across the first axis A1. The pair of first key portions 39*b*1 and the pair of first key portions 39*b*2 are formed in symmetrical positions across the second axis A2.

However, the Oldham coupling 39 may also, instead of having the two pairs of first key portions 39*b*, have just one of the pair of first key portions 39*b*1 and just one of the pair of first key portions 39*b*2. That is, the first key portions 39*b* of the Oldham coupling 39 may be configured from just one first key portion 39*b*1 and one first key portion 39*b*2.

Figure 11:
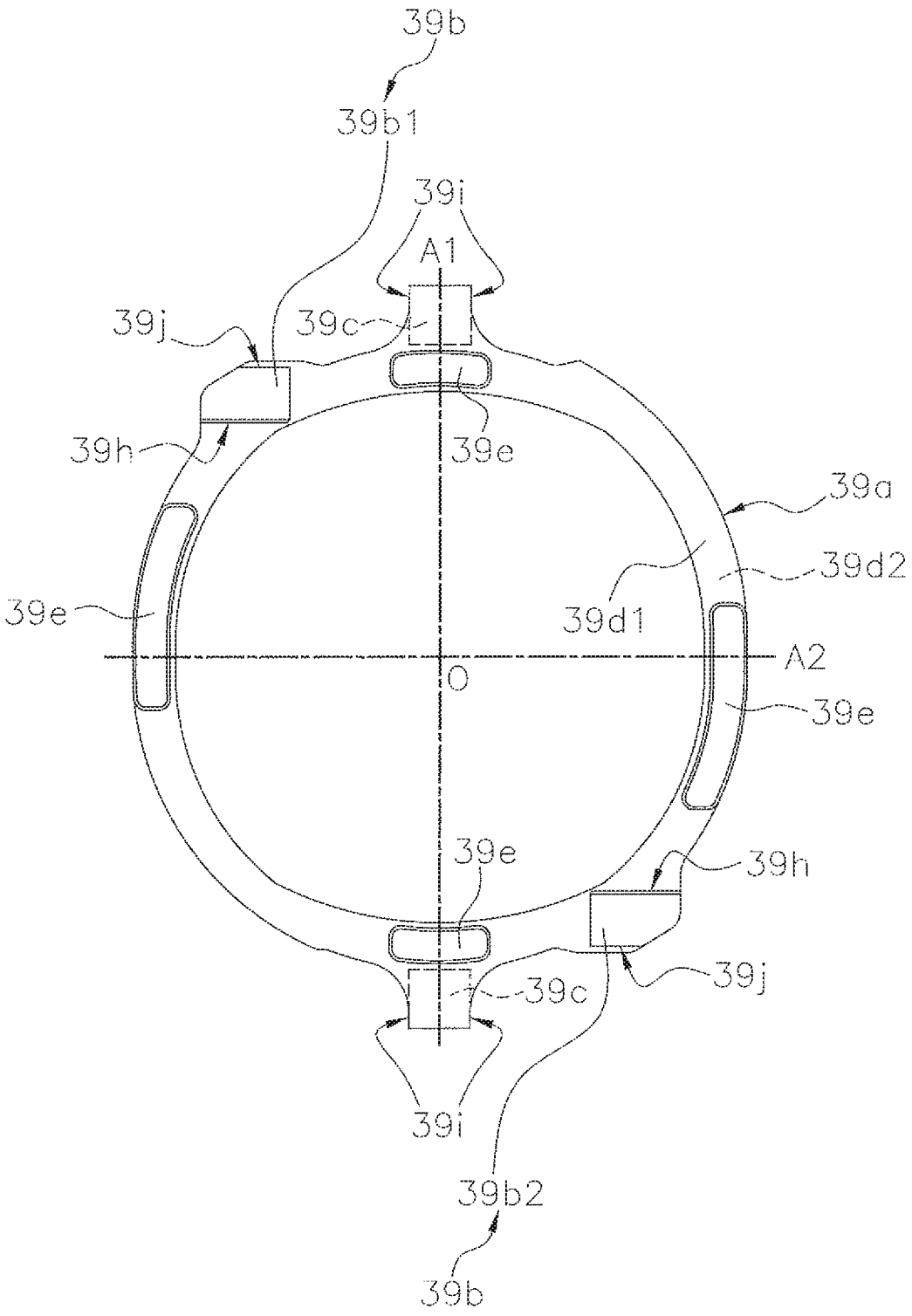
FIG. 11 is a top view of the Oldham coupling 39 of example modification A.
Figure 12:
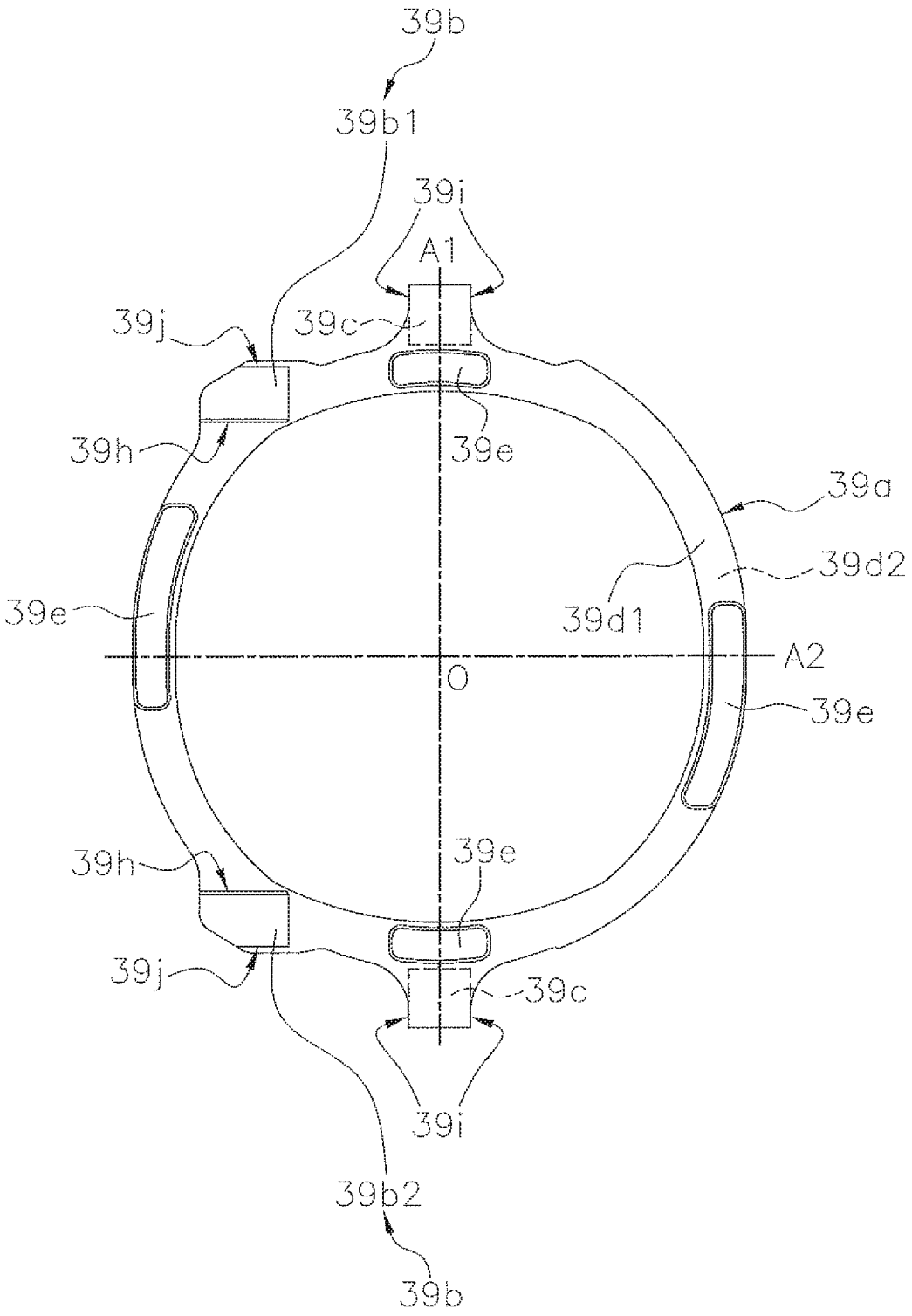
FIG. 12 is a top view of the Oldham coupling 39 of example modification A.

As examples, FIG. 11 and FIG. 12 are top views of the Oldham coupling 39 of the present example modification. In FIG. 11 and FIG. 12, the Oldham coupling 39 has one first key portion 39*b*1 and one first key portion 39*b*2. In the Oldham coupling 39 shown in FIG. 11, the two first key portions 39*b*1 and 39*b*2 are formed in symmetrical positions with respect to the center of gravity O of the Oldham coupling 39. In the Oldham coupling 39 shown in FIG. 12, the two first key portions 39*b*1 and 39*b*2 are formed in symmetrical positions across the second axis A2. Furthermore, the two first key portions 39*b*1 and 39*b*2 may be formed in symmetrical positions across the first axis A1 from the positions shown in FIG. 11 and FIG. 12.

In this example modification also, seizure of the first sliding surfaces 39*h* of the first key portions 39*b*1 and 39*b*2 is inhibited because of the same reasons as in the embodiment. Consequently, the scroll compressor 101 has high reliability by inhibiting seizure of the sliding surfaces of the Oldham coupling 39 and the movable scroll 26.

Furthermore, in this example modification, it suffices for the Oldham coupling 39 to have at least two first key portions 39*b* among the four first key portions 39*b* shown in FIG. 8. That is, the Oldham coupling 39 may also have two or three first key portions 39*b*. In this case, the first key portions 39*b* are provided in any of the four regions partitioned by the first axis A1 and the second axis A2, and two or more of the first key portions 39*b* are not provided in the same region.

(4-2) Example Modification B

In the embodiment, when the Oldham coupling 39 is seen along the vertical direction, the inner peripheral surface of the annular body portion 39*a* has a circular arc shape. However, the inner peripheral surface of the annular body portion 39*a* may also have an arbitrary shape.

Figure 13:
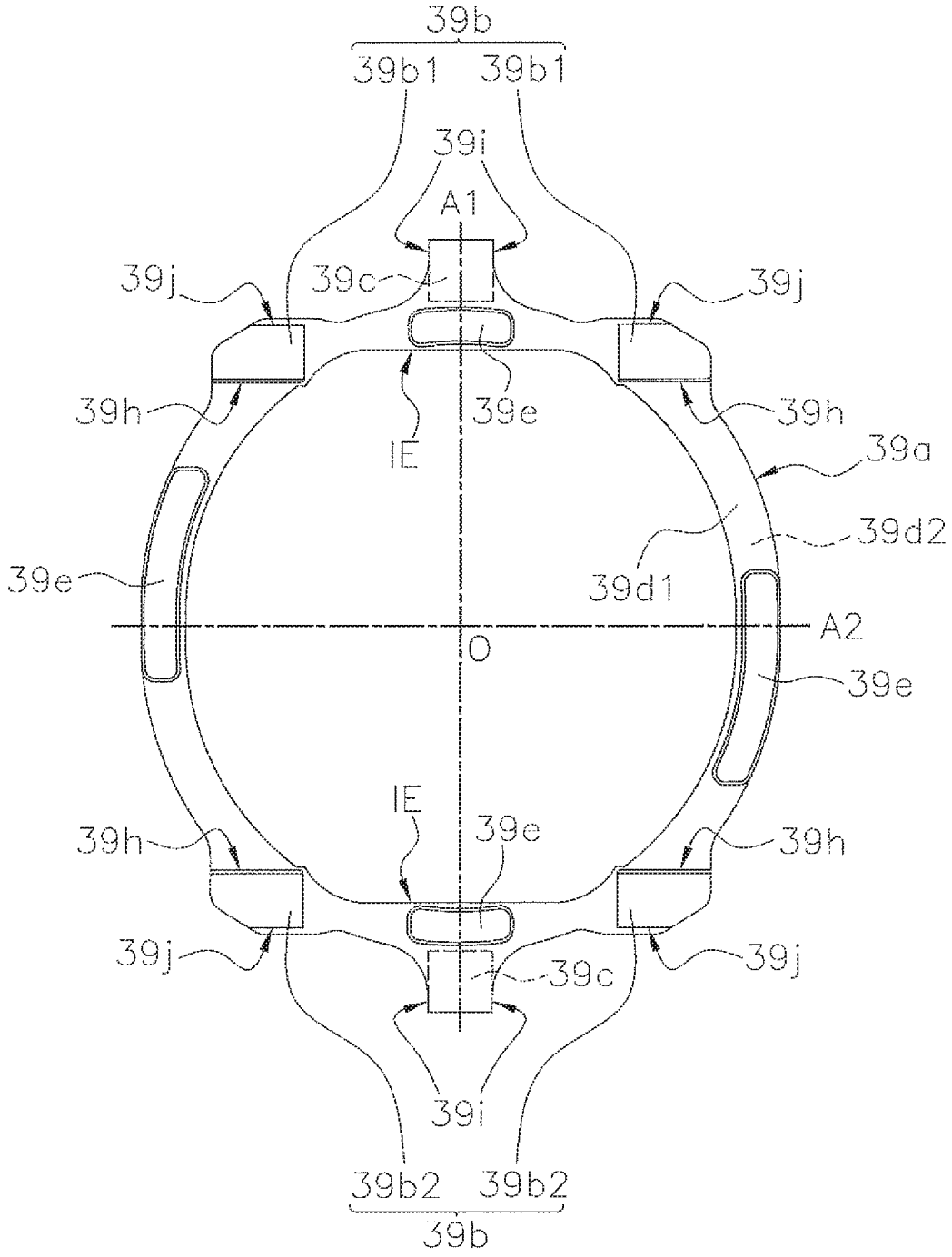
FIG. 13 is a top view of the Oldham coupling 39 of example modification B.
Figure 14:
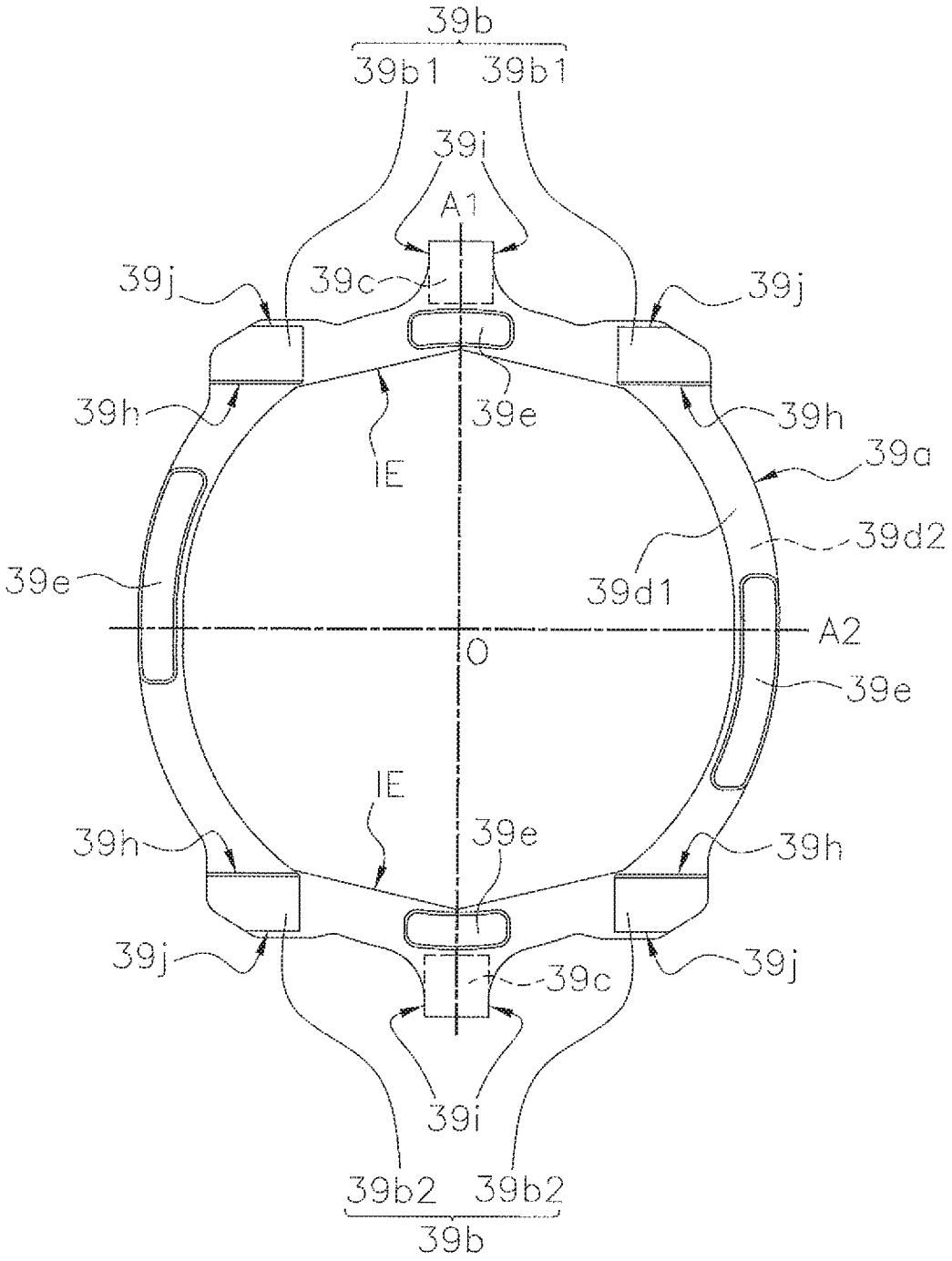
FIG. 14 is a top view of the Oldham coupling 39 of example modification B.

As examples, FIG. 13 and FIG. 14 are top views of the Oldham coupling 39 of the present example modification. In FIG. 13, the shape of the inner peripheral surface of the annular body portion 39*a* includes linear portions IE that are parallel to the second axis A2 between the pair of first key portions 39*b*1 and between the pair of first key portions 39*b*2. In FIG. 14, the shape of the inner peripheral surface of the annular body portion 39*a* includes linear portions IE that are not parallel to the second axis A2 between the pair of first key portions 39*b*1 and between the pair of first key portions 39*b*2.

It will be noted that, in this example modification, the first key portions 39*b* of the Oldham coupling 39 may also be configured from just one first key portion 39*b*1 and one first key portion 39*b*2 as in example modification A.

INDUSTRIAL APPLICABILITY

The scroll compressor pertaining to the invention has high reliability by inhibiting seizure of sliding surfaces of an Oldham coupling and a movable scroll.

What is claimed is:

1. A scroll compressor comprising:

a movable scroll having first key grooves;

a stationary member having second key grooves; and an Oldham coupling provided between the movable scroll and the stationary member, the Oldham coupling being relatively movable with respect to the stationary member along a direction in which a first axis extends, and the Oldham coupling being relatively movable with respect to the movable scroll along a direction in which a second axis extends, the second axis being orthogonal to the first axis and passing through a center of gravity of the Oldham coupling, the Oldham coupling having an annular body portion having a first horizontal surface and a second horizontal surface that oppose each other and face in opposite directions, at least two first key portions that project from the first horizontal surface, are fitted into the first key grooves, are slidable against the movable scroll along the direction in which the second axis extends, and are away from the second axis, and second key portions that project from the second horizontal surface, are fitted into the second key grooves, and are slidable against the stationary member along the direction in which the first axis extends, and key gaps being formed between outer peripheral surfaces of the first key portions and inner peripheral surfaces of the first key grooves, the key gaps having first gaps formed along the direction in which the second axis extends, and second gaps formed along the direction in which the second axis extends, the second gaps being wider than the first gaps, the first gaps being located closer to the second axis than the second gaps.

2. The scroll compressor according to claim 1, wherein the first gaps are 15 μm to 50 μm.

3. The scroll compressor according to claim 2, wherein the second gaps are 200 μm to 1000 μm.

4. The scroll compressor according to claim 2, wherein the first key portions are provided in any of four regions partitioned by the first axis and the second axis, and two or more of the first key portions are not provided in a same region.

5. The scroll compressor according claim 2, wherein the Oldham coupling has two pairs of the first key portions.

6. The scroll compressor according to claim 1, wherein the second gaps are 200 μm to 1000 μm.

7. The scroll compressor according to claim 6, wherein the first key portions are provided in any of tour regions partitioned by the first axis and the second axis, and two or more of the first key portions are not provided in a same region.

8. The scroll compressor according claim 3, wherein the Oldham coupling has two pairs of the first key portions.

9. The scroll compressor according to claim 1, wherein the first key portions are provided in any of four regions partitioned by the first axis and the second axis, and two or more of the first key portions are not provided in a same region.

10. The scroll compressor according to claim 9, wherein the Oldham coupling has a pair of the second key portions, and the second key portions are provided on the first axis across the second axis.

11. The scroll compressor according claim 10, wherein the Oldham coupling has two pairs of the first key portions.

12. The scroll compressor according claim 9, wherein the Oldham coupling has two pairs of the first key portions.

13. The scroll compressor according to claim 1, wherein the Oldham coupling has two pairs of the first key portions.

* * * * *